United States Patent [19]

Bensadoun

[11] 4,325,049

[45] Apr. 13, 1982

[54] ELECTRODE FOR A LIQUID RHEOSTAT, AND A LIQUID RHEOSTAT INCLUDING SUCH AN ELECTRODE

[76] Inventor: Michel Bensadoun, 13 Avenue de Limoges, 87270 Couzeix, France

[21] Appl. No.: 73,748

[22] Filed: Sep. 10, 1979

[30] Foreign Application Priority Data

Sep. 13, 1978 [FR] France ..... 78 26267

[51] Int. Cl.[3] ..... H01C 10/02

[52] U.S. Cl. ..... 338/86; 338/94; 338/294; 338/296; 338/304

[58] Field of Search ..... 338/80, 55, 86, 33, 338/92, 83, 94, 333, 334, 296, 299, 304; 219/288; 323/99; 318/482

[56] References Cited

U.S. PATENT DOCUMENTS

| | | | |
|---|---|---|---|
| 1,196,254 | 8/1916 | McCormick | 338/55 |
| 1,232,450 | 7/1917 | Misland | 338/333 X |
| 1,267,973 | 5/1918 | Chubb | 338/55 |
| 1,332,167 | 2/1920 | DeWein | 338/86 X |
| 1,374,562 | 4/1921 | Hall | 338/86 X |
| 1,547,858 | 7/1925 | Cowin | 338/86 X |
| 1,688,202 | 10/1928 | Neall et al. | 219/288 |
| 3,297,972 | 1/1967 | Hyde | 338/86 |

FOREIGN PATENT DOCUMENTS

| | | | |
|---|---|---|---|
| 1216101 | 11/1959 | France | 338/86 |
| 365002 | 1/1932 | United Kingdom . | |
| 562537 | 7/1944 | United Kingdom . | |
| 1036178 | 7/1966 | United Kingdom . | |

*Primary Examiner*—C. L. Albritton
*Attorney, Agent, or Firm*—Charles E. Brown

[57] ABSTRACT

An electrode for a liquid rheostat comprises a plurality of globally annular elements arranged successively and electrically connected together two at a time. The annular elements progressively decrease in size. The electrode can be formed from a continuous metal strand wound in a spiral, the turns of the strand forming the annular elements. A liquid rheostat including such electrodes is particularly suitable for starting an electric motor as it produces a gradual start up characteristic.

14 Claims, 5 Drawing Figures

ELECTRODE FOR A LIQUID RHEOSTAT, AND A LIQUID RHEOSTAT INCLUDING SUCH AN ELECTRODE

BACKGROUND OF THE INVENTION

The present invention relates, in general terms to automatic liquid rheostats appropriate for starting any type of motor, and more particularly concerns liquid rheostats which are of variable level.

Such a liquid rheostat, which is described, for example, in French Pat. No. 1,216,101, comprises, in general terms, a reservoir which contains the electrolyte, a starting cell, in the upper part of which are located electrodes, and a connecting pipeline, which is suitable for the controlled passage of electrolyte between the said reservoir and the said cell.

Where, for example, the starting of a motor with rotor starting is concerned, the electrodes of such a liquid rheostat are connected to the winding of such a motor, and control means are provided to ensure, for starting, that the electrolyte progressively enters the starting cell by forced circulation of this electrolyte from the reservoir to the starting cell through the connecting pipeline.

During starting, an increased length of each electrode is progressively, immersed in the electrolyte, and thus short-circuited, and only the parts of the electrodes which project from the electrolyte continue to introduce resistance into the circuit.

In order that the starting is as gradual as possible, it is important that the area of the surface of each electrode in contact with the electrolyte can be greatly varied, the contact surface area being at a minimum at the commencement of starting and at a maximum on termination of starting.

In the liquid rheostats known hitherto, either the electrodes are solid, such being the case in German patent application No. 1,465,596, or the electrolytes are hollow but each constitute a closed volume, such being the case in the abovementioned French Pat. No. 1,216,101; in all cases, only the external periphery of the electrodes is in contact with the electrolyte.

As a result, the maximum surface area of such an electrode in contact with the electrolyte is necessarily small.

SUMMARY OF THE PRESENT INVENTION

It is an object of the present invention to provide an electrode which, in contast to known electrodes, has a greater surface area in contact with the electrolyte when other conditions are constant.

According to the present invention there is provided an electrode for a liquid rheostat, the electrode comprising a plurality of globally annular elements arranged successively, said elements being electrically connected together two at a time.

The globally annular elements preferably progressively decrease in size.

In an embodiment of the invention, which is preferred because it is economical, the globally annular elements which such an electrode comprises are formed conjointly and continuously from a single metal strand which is wound in a spiral, successive turns of said spiral constituting the said annular elements.

The globally annular elements, however formed, together form a chimney of which not only the external periphery but also the internal periphery can come into contact with the electrolyte.

Furthermore, because of the contour of its cross-section, which may or may not be circular, each globally annular element of the electrode individually offers the maximum surface area in contact with the electrolyte.

The present invention further relates to a liquid rheostat of which the electrodes, or at least one of the electrodes, comprises, in this way, a succession of globally annular elements which conjointly form a chimney.

As a result of the advantages inherent in such an embodiment, as presented above, such a liquid rheostat has, for a given volume of the starting cell, a possible contact surface area between the electrode and the electrolyte which is greater than that of the comparable liquid rheostats known hitherto, and is thus capable of controlling the starting of more powerful motors.

The contour of the globally annular elements which form an electrode according to the invention is optional.

However, the contour is preferably circular, as this permits optimistation of the distances between electrodes and the distances between electrodes and the wall of the starting cell, this being particularly valuable in relation to the operating conditions which are set up at the end of the starting operation.

Preferably, furthermore, the chimney which such globally annular elements conjointly form is in the general shape of a truncated cone, which on the one hand makes it possible to achieve more gradual starting and on the other hand makes it possible to avoid triggering an electric arc at the commencement of such a starting operation.

BRIEF DESCRIPTION OF THE DRAWINGS

An embodiment of the present invention will hereinafter be described, by way of example, with reference to the accompanying drawings, in which.

DESCRIPTION OF THE PREFERRED EMBODIMENT

Figure 1:
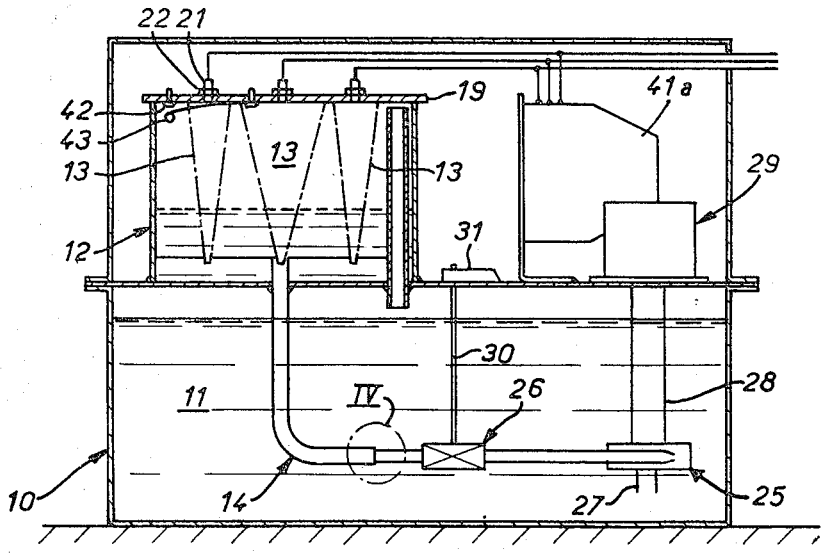
FIG. 1 shows in elevation a liquid rheostat equipped with electrodes according to the invention.

As is shown in FIG. 1, a liquid rheostat according to the invention comprises a reservoir 10 which contains an electrolyte 11 and a starting cell 12 which is located above the reservoir 10. Electrodes 13 are located in the upper part of the cell 12, and a connecting pipeline 14 extends between the reservoir 10 and the starting cell 12 to allow controlled passage of electrolyte 11 between the reservoir and the cell, as is explained in detail later.

Figure 2:
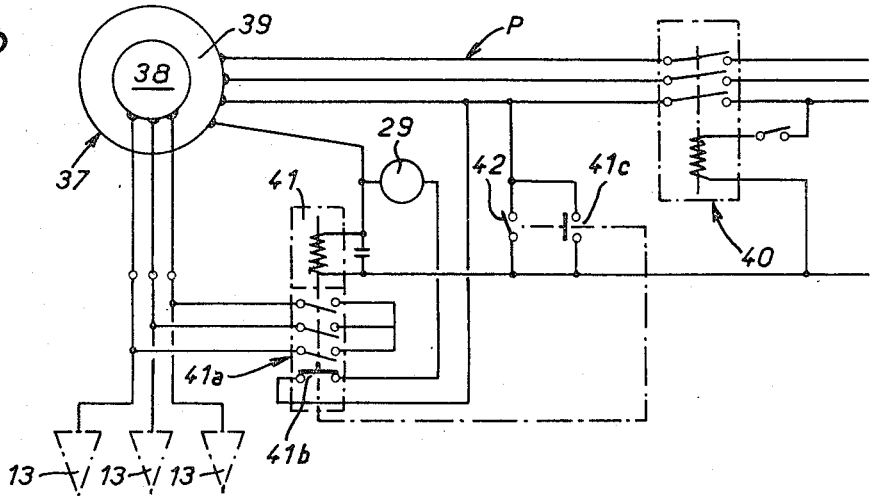
FIG. 2 is a circuit diagram of the liquid rheostat and of its connection to a motor whose starting it is to control.

In both FIGS. 1 and 2 only the contour of each electrode 13 is indicated in broken lines.

Figure 3:
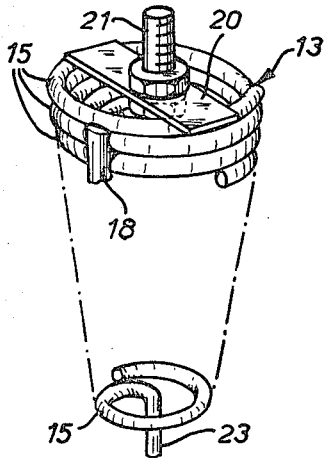
FIG. 3 is a partial perspective view of an electrode according to the invention, fitted to the liquid rheostat.

As can be seen from FIG. 3, in which one of the electrodes 13 is shown separately, each electrode 13 comprises a succession of globally annular elements 15 which are electrically connected two at a time and, in the illustrative embodiment shown, are of progressively decreasing sizes, the element of larger size being at the upper part of the starting cell 12, whilst the element of smaller size is at the lower part of the said starting cell.

In the embodiment shown, the electrode is constituted by the succession of globally annular elements 15, and these elements being conjointly and continuously to one and the same metal strand wound in a spiral, of which they form the successive turns.

By way of indication, and without implying a limitation, it should be stated here that each electrode according to the invention can be produced in this way with the aid of a metal strand 7 m long.

In the illustrative embodiment shown, the cross-section of this strand is circular and has, for example, a diameter of 8 mm, but this cross-section can also be non-circular, for example square.

Whatever the cross-section, the globally annular elements 15 of which constitute an electrode 13 according to the invention together define a chimney of which not only the external periphery but also the internal periphery can be in contact with the electrolyte 11 and, in view of the circular contour of these globally annular elements, and in view of their progressively decreasing sizes, the general shape of this chimney is that of a truncated cone.

The globally annular elements 15 which constitute an electrode 13 according to the invention may or may not be successively joined together, two at a time if maximum resistance to starting is desired, it is preferable that they should not be joined together, two at a time.

If desired, and in order to provide better mechanical stability of the electrode 13 which they constitute, the globally annular elements 15 are connected, two at a time, transversely by means of at least one local connecting bridge, as is shown diagrammatically at 18 for two of the elements in FIG. 3.

Such a local connecting bridge can for example be produced by welding.

An electrode 13 according to the invention is suspended, by its globally annular element 15 of maximum size, from a cover 19 which closes the starting cell 12. A bar 20 is connected to the largest element 15 transversely thereof between two diametrically opposite points of the element; and this bar 20 carries a threaded bolt 21 which extends axially of the bar 20 and passes through the cover 19. A holding nut 22 is provided on the outer side of the cover 19 and is engaged on the bolt 21.

Finally, in the embodiment shown, the strand from which the globally annular elements 15 of the electrode 13 are formed is continued beyond the element of smallest size and projects axially towards the bottom of the starting cell 12, to form a contact point 23.

In the embodiment shown, the connecting pipeline 14 is connected, on the side of the reservoir 10, to a pumping means 25, and on the side of the starting cell 12, to a regulating valve 26.

For example, the pumping means 25 can consist of a centrifugal pump having a suction inlet 27 immersed in the electrolyte 11 in the reservoir 10. The motor control shaft of the pump is covered by a protective sleeve 28 and connected onto the output shaft of a motor 29.

Also by way of example, the regulating valve 26 is a rotary valve connected by a linkage rod system 30 to a control lever 31 which the user can operate; however, the valve can also be, for example, a slide valve.

Figure 4:
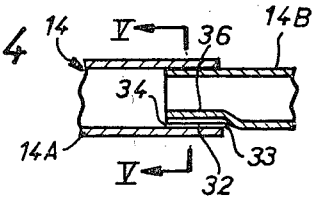
FIG. 4 shows, on a larger scale and in axial section, the detail of FIG. 1 marked IV.
Figure 5:
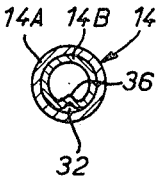
FIG. 5 is a cross-section taken along line V—V of FIG. 4.

Downstream of the regulating valve 26, relative to the pumping means 25, the connecting pipeline 14 is locally perforated by the provision of a passage arranged in general terms like a whistle 32, FIGS. 4 and 5, of which the external outlet 33 is on the side of the regulating valve 26, and hence of the reservoir 10, whilst the internal outlet is on the side of the starting cell 12.

For example, and as shown, the connecting pipeline 14 consists of two tubes 14A, 14B, of different diameters, pushed into one another, and the passage 33 is formed by a longitudinal deformation, in the shape of a half-wave 36, of the tube 14B of lesser diameter, this longitudinal deformation 36 projecting radially towards the interior of the said tube and affecting the end of the said tube which is pushed into the tube 14A of greater diameter.

The other components of the rheostat in question do not form part of the present invention and will therefore not be described in detail here; they are furthermore well known in themselves.

It should merely be stated that, according to the invention, the volume of the reservoir 10 is a multiple of the volume of the starting cell 12, which, in operation, allows a slower rise in temperature of the electrolyte 11 contained in this reservoir 10 and thus allows a plurality of successive starting operations, in rapid sequence, without danger and without employing any other means of cooling.

The circuit diagram of FIG. 2 illustrates, by way of an example, the application of the liquid rheostat described above to the starting of a motor 37 with rotor starting.

In a manner known per se, the electrodes 13 are connected to the rotor 38 of this motor, whilst the conductors P of any suitable three-phase supply are connected to the stator 39 of the motor. A starting relay 40, which controls contacts interposed in the conductors P, is connected between one of the conductors P and a neutral conductor N. The motor 29 and a short-circuit relay 41 are also connected between said one conductor P and the neutral N. The relay 41 controls short-circuit contacts **41*a* connected in parallel to the electrodes 13 and a contact 41*b* interposed on the supply line of the motor 29**.

The short-circuit relay 41 also controls a self-supply contact **41*c*. In addition, a contact 42 is interposed in the supply line of the relay 41, the contact 42 being controlled, in the embodiment shown, by a float 43 installed in the upper part of the cell 12**.

The connecting pipeline 14 projects slightly upwardly from the bottom of the cell 12, so that, during a waiting period, and as shown in solid lines in FIG. 1, a minimum volume of electrolyte is present in this cell.

During such a waiting period, only the points 23 of the electrodes 13 are in contact with the electrolyte.

Furthermore, during the waiting period, the contact **41*b* which controls the supply of the motor 29 is closed. Thus, on starting, this motor 29 immediately comes into action. The pump 25 which is controlled by the motor 29 thus immediately delivers electrolyte 11 into the cell 12, which fills gradually so that, as shown in broken lines in FIG. 1, a progressively increasing part of the electrodes 13 is immersed in this electrolyte, thereby providing the desired gradual character of the starting-up of the motor 37**.

The valve 26 makes it possible to regulate the delivery of the pump 25.

However, the flow of electrolyte delivered by the pump is increased by an induced flow drawn directly from the reservoir 10 into the connecting pipeline 14 through the oriented passage 32 present in the said pipeline.

When the level of electrolyte in the cell 12 reaches the float 43, the latter closes the contact 42 so that the short-circuit relay 41 is energized. Thus, the contacts 41*a* short-circuit the electrodes 13 and the contact 41*b* interrupts the supply to the motor 29.

The electrolyte present in the cell 12 flows back through the connecting pipeline 14 into the reservoir 10.

The greater part of this backflow passes through the pump 25, which then acts as a turbine.

However, advantageously, a defined part of this backflow directly re-enters the reservoir 10 via the passage 32 of the connecting pipeline 14, so that the cell 12 is emptied rapidly, regardless of the throttling of this connecting pipeline 14 attributable to the regulating valve 26.

At the same time, the short-circuit relay 41 remains energized by way of its self-supply contact 41*c*.

Of course, the present invention is not confined to the embodiment described and shown, but encompasses any variant, in particular as regards the number, contour and cross-section of the globally annular elements 15 which constitute each electrode 13, and/or in respect of the length of the strand from which the globally annular elements are formed as successive turns, and/or in respect of the general shape of the chimney which the globally annular elements form conjointly.

Furthermore, the float 43 can be replaced by a constant-pressure regulator connected to a compression chamber in the starting cell.

Furthermore, although it is generally preferred that the globally annular elements which constitute each electrode should progressively decrease in size, in order to form a chimney in the general shape of a truncated cone and to ensure a gradual start up characteristic, this arrangement is not essential.

Finally, the field of application of the present invention is not restricted only to the starting of motors with rotor starting, but, on the contrary, also embraces the starting of motors which, as for example in the case of squirrel cage motors, employ stator starting; in that case, it suffices to place the electrodes of the rheostat employed at the star point of the stator of such a motor.

I claim:

1. An electrode for a liquid rheostat, said electrode comprising a plurality of generally annular elements, consecutive elements being electrically connected in series, and connecting bridge members arranged transversely of and connecting transversely adjacent like parts of said annular elements together.

2. An electrode for a liquid rheostat, said electrode comprising a single continuous spirally would electrically conducting metal strand forming a plurality of adjacent turns, each of said turns defining a generally annular element, the adjacent ones of said generally annular elements being mechanically connected together.

3. An electrode according to claim 1 or claim 2, wherein said generally annular elements progressively decrease in size, for increasingly varying the surface area of consecutive annular elements immersible in the electrolyte and thereby the resistance of said rheostat.

4. An electrode according to claim 1 or claim 2, wherein said generally annular elements together define a chimney which is of generally frustoconical configuration, for increasingly varying the surface area of consecutive annular elements immersible in the electrolyte and thereby the resistance of said rheostat.

5. A liquid rheostat comprising a reservoir for an electrolyte, a starting cell, a plurality of electrodes located in the starting cell, and means including a connecting line for controlled flow of electrolyte between said reservoir and said starting cell and thereby controlling the portions of the electrodes immersed in said starting cell, the improvement comprising at least one of said electrodes being of hollow configuration with an open lower end and comprising a plurality of generally annular elements with consecutive elements electrically connected in series, whereby both radially inner and outer surfaces of the annular elements are adapted to be in contact with the electrolyte when the corresponding portions of the electrodes are immersed therein.

6. A liquid rheostat according to claim 5, said starting cell being located above said reservoir, said electrodes being located in the upper part of the starting cell, and said connecting line being connected, on the reservoir side, to pumping means, and on the starting cell side, to a regulating valve, wherein, downstream of the said regulating valve relative to said pumping means, said connecting line is locally perforated by a passage having the external outlet on the reservoir side and an internal outlet on the starting cell side.

7. A rheostat according to claim 6, wherein the connecting line comprises two tubes of different diameters, fitted in side each other, and said passage comprising a longitudinal deformation of said tube of lesser diameter, said deformation projecting radially inwardly of the said tube and coacting with the end of the said tube which is fitted in said tube of larger diameter.

8. A rheostat according to claim 5, wherein said electrodes are connected to a star point of the stator of a motor with stator starting means.

9. A rheostat according to claim 5, wherein the volume of said reservoir is a multiple of that of said starting cell.

10. The liquid rheostat according to claim 5, wherein said generally annular elements progressively decrease in size, for increasingly varying surface area of consecutive annular elements immersible in the electrolyte and thereby the resistance of said rheostat.

11. The liquid rheostat according to claim 10, wherein two adjacent annular elements are connected together by connecting bridge members arranged transversely of said elements.

12. The liquid rheostat according to claim 5, wherein the electrode comprises a single continuous spirally wound electrically conducting metal strand forming a plurality of adjacent turns, each said turn defining one of said generally annular elements of said electrode.

13. The liquid rheostat according to claim 12, wherein adjacent ones of said generally annular elements are mechanically connected together.

14. The liquid rheostat according to claim 5, said hollow configuration of said electrode being downwardly tapering for increasingly varying the surface area of consecutive annular elements immersible in the electrolyte and thereby the resistance of the rheostat.

* * * * *